US009187871B1

(12) United States Patent
Contreras

(10) Patent No.: US 9,187,871 B1
(45) Date of Patent: Nov. 17, 2015

(54) PET WASTE COLLECTOR

(71) Applicant: Alba I. Contreras, Lexington, KY (US)

(72) Inventor: Alba I. Contreras, Lexington, KY (US)

( * ) Notice: Subject to any disclaimer, the term of this patent is extended or adjusted under 35 U.S.C. 154(b) by 0 days.

(21) Appl. No.: 14/460,664

(22) Filed: Aug. 15, 2014

Related U.S. Application Data

(60) Provisional application No. 61/866,192, filed on Aug. 15, 2013.

(51) Int. Cl.
*A01K 29/00* (2006.01)
*E01H 1/12* (2006.01)

(52) U.S. Cl.
CPC ..... *E01H 1/1206* (2013.01)

(58) Field of Classification Search
CPC ..... E01H 1/1206; E01H 1/006; E01H 1/12; E01H 2001/128; E01H 2001/1293; A01K 23/005
USPC ..... 294/1.4, 1.3, 1.5; 248/100, 101
See application file for complete search history.

(56) References Cited

U.S. PATENT DOCUMENTS

| | | | | |
|---|---|---|---|---|
| 3,868,135 | A | 2/1975 | Magliaro | |
| 4,225,169 | A * | 9/1980 | DeToma | 294/1.4 |
| 4,225,174 | A * | 9/1980 | Hennessy et al. | 294/1.4 |
| 4,819,977 | A | 4/1989 | Cooper | |
| 5,503,442 | A * | 4/1996 | Lee | 294/1.4 |
| 5,669,645 | A * | 9/1997 | Chuang | 294/1.3 |
| 5,704,669 | A * | 1/1998 | Clark | 294/209 |
| D409,804 | S | 5/1999 | Nunes | |
| 6,059,332 | A * | 5/2000 | Beascoechea Inchaurraga | 294/1.3 |
| 6,279,975 | B1 * | 8/2001 | Gamliel | 294/1.3 |
| 6,641,188 | B2 | 11/2003 | Arceo | |
| 7,523,972 | B1 * | 4/2009 | Wawrzynowski | 294/1.3 |
| 7,625,025 | B1 | 12/2009 | Zahedi | |
| 7,631,910 | B2 | 12/2009 | Shalhoub | |
| 7,992,907 | B1 * | 8/2011 | DeJesus | 294/1.4 |
| 8,002,319 | B1 | 8/2011 | Hahn | |
| 8,714,604 | B1 * | 5/2014 | Mihalic | 294/1.4 |
| 8,899,643 | B2 * | 12/2014 | Sigmund | 294/1.3 |
| 9,004,563 | B2 * | 4/2015 | Buzby et al. | 294/210 |
| 2004/0135386 | A1 | 7/2004 | Pineda | |
| 2004/0145196 | A1 * | 7/2004 | Katz | 294/1.4 |
| 2005/0218675 | A1 * | 10/2005 | Jung | 294/1.4 |
| 2006/0214442 | A1 * | 9/2006 | Jones | 294/1.4 |
| 2008/0030033 | A1 * | 2/2008 | Taylor | 294/1.4 |
| 2008/0265592 | A1 * | 10/2008 | Askinasi | 294/1.4 |
| 2009/0200812 | A1 * | 8/2009 | Mambru | 294/1.4 |
| 2012/0292933 | A1 | 11/2012 | Krupp | |
| 2013/0062896 | A1 * | 3/2013 | Ahern et al. | 294/1.4 |
| 2014/0152033 | A1 * | 6/2014 | Wilson | 294/1.4 |
| 2015/0021943 | A1 * | 1/2015 | Montgomery | 294/1.4 |
| 2015/0102617 | A1 * | 4/2015 | Pluta | 294/1.4 |

FOREIGN PATENT DOCUMENTS

| | | | | |
|---|---|---|---|---|
| DE | 102009021875 | * 11/2010 | | E01H 1/12 |
| GB | 2168596 A | * 6/1986 | | E01H 1/1206 |

* cited by examiner

*Primary Examiner* — Gabriela Puig
(74) *Attorney, Agent, or Firm* — Robert C. Montgomery; Montgomery Patent & Design, LLC

(57) ABSTRACT

A pet waste collector including a shaft including a first end and a second end, a clamp mechanism connected to the second end of the shaft, and an actuator mechanism operably connected to the clamp mechanism, the actuator mechanism be disposed at the first end of the shaft. The clamp mechanism is movable between an open position and a closed position. The clamp mechanism is configured to retain a bag in the open position. The clamp mechanism moves to the closed position in response to actuation of the actuator mechanism to capture pet waste within the bag.

16 Claims, 4 Drawing Sheets

PET WASTE COLLECTOR

RELATED APPLICATIONS

The present invention was first described in and claims the benefit of U.S. Provisional Application No. 61/866,192, filed Aug. 15, 2013, the entire disclosures of which are incorporated herein by reference.

FIELD OF THE INVENTION

The present invention relates generally to pet waste collectors and, more particularly, to a pet waste collector that utilizes disposable bags.

BACKGROUND OF THE INVENTION

Recent history has seen a proliferation of dogs being adopted as household pets. Pets provide many benefits to our lives; yet, every benefit has an associated duty. Duties associated with pets include caring for them, spending time with them, feeding them, walking them, and, of course, cleaning up after them.

The days of tying up the dog to a post and providing a doghouse in the back yard are over, which is seen, at the very least as socially unacceptable and at most inhumane treatment. Consequently, most pets live in the house with us and must be walked throughout the neighborhood for exercise.

As pets are no longer confined to the back yard, cleaning up after them has taken on a heightened sense of duty. Laws, and the enforcement of them, have become strict regarding cleaning up after pets. This requires having something portable to bring with us during walks that can be used to collect pet waste and transport it back to the home.

Pet waste collectors do exist, but they tend to be heavy and unwieldy. Furthermore, the use of them requires one to clean the fecal matter from the apparatus after use. For this reason pet owners tend to opt for plastic bags as a source of waste collection. The use of bags, however, requires one to kneel down close to the waste, use one's hand as the means to entrain the waste, and carry the entrained waste within the bag back to the home.

Accordingly, there exists a need for a means by which the functionality of a pet waste collector and the ease and convenience of a waste bag can be exploited in one device.

SUMMARY OF THE INVENTION

The inventor has recognized the aforementioned inherent problems and lack in the art and observed that there is a need for an improved pet waste collector. The development of the present invention, which will be described in greater detail herein, substantially departs from conventional solutions to fulfill this need.

In one (1) embodiment, the disclosed pet waste collector including a shaft including a first end and a second end, a clamp mechanism connected to the second end of the shaft, and an actuator mechanism operably connected to the clamp mechanism, the actuator mechanism be disposed at the first end of the shaft. The clamp mechanism is movable between an open position and a closed position. The clamp mechanism is configured to retain a bag in the open position. The clamp mechanism moves to the closed position in response to actuation of the actuator mechanism to capture pet waste within the bag.

In another embodiment, the disclosed pet waste collector including a plurality of tubes, the plurality of tubes being releasably connected to form a shaft including a first end and a second end, a clamp mechanism connected to a lowermost tube of the plurality of tubes at the second end of the shaft, the clamp mechanism including a flexible framework defining a mouth configured to retain a bag, a flexible cord extending through the plurality of tubes from the first end of the shaft to the second end of the shaft, the cord including a first end and a second end, the second end connected to the mouth of the framework of the clamp mechanism, an actuator mechanism connected to the first end of the cord, a spool assembly disposed within the lowermost tube at the second end of the shaft, the spool assembly including a plurality of the bags wound therearound, and a door hingedly connected to the lowermost tube at the second end of the shaft and covering an opening into the lowermost tube. The flexible framework of the clamp mechanism is biased in an open position. Actuation of the actuator mechanism exerts a tensile force upon the mouth of the flexible framework of the clamp mechanism to move the flexible framework of the clamp mechanism to a closed position to capture pet waste within the bag. The bag is removed from within flexible framework of the clamp mechanism through the opening.

Furthermore, the described features and advantages of the disclosure may be combined in various manners and embodiments as one skilled in the relevant art will recognize. The disclosure can be practiced without one or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
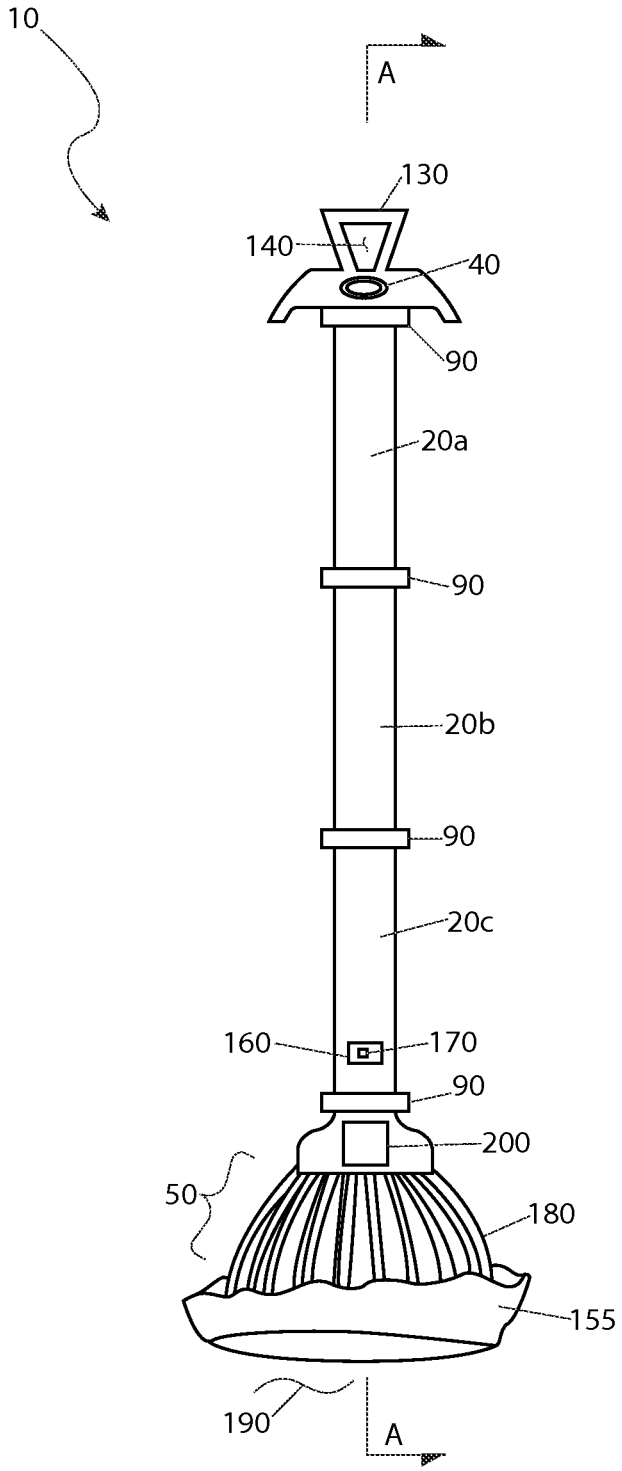
FIG. 1 is a front elevational view of the disclosed pet waste collector, according to one embodiment of the present invention.

10 pet waste collector
15 shaft
20*a* first tube
20*b* second tube
20*c* third tube
21*a* first curvature
21*b* second curvature
21*c* third curvature
30 cord
40 actuator mechanism
50 clamp mechanism
60 first end
70 second end
80 stripped surface
90 locking coupling
100 flange
110 locking mechanism

120 eyelet
130 handle
140 aperture
150 spool assembly
155 waste bag
160 hinged door
170 latch
180 framework
190 mouth
200 port

DETAILED DESCRIPTION OF THE INVENTION

In accordance with the invention, the best mode is presented in terms of a one or more of the disclosed embodiments, herein depicted within FIGS. 1 through 4. However, the disclosure is not limited to a single described embodiment and a person skilled in the art will appreciate that many other embodiments are possible without deviating from the basic concept of the disclosure and that any such work around will also fall under its scope.

Further, those skilled in the art will recognize that other styles and configurations can be incorporated into the teachings of the present disclosure, and that the example configurations shown and described herein are for the purpose of clarity and disclosure and not by way of limitation.

As used herein, the singular terms "a", "an", and "the" do not denote a limitation of quantity, but rather denote the presence of at least one (1), as well as a plurality of, the referenced items, unless the context clearly indicates otherwise.

As used herein, the terms "first", "second", "third", etc. are used as labels to describe various elements, features, and/or components, and are not intended to impose ordinal, positional, or hierarchical requirements on the referenced items, unless other indicated. For example, such terms may be used to distinguish one (1) element from another element.

As used herein, relative terms such as "front", "rear", "left", "right", "top", "bottom", "below", "above", "upper", "lower", "horizontal", or "vertical" are used to describe a relationship of one (1) element, feature and/or region to another element, feature and/or region as illustrated in the figures.

Referring to FIGS. 1-4, disclosing a hand-held pet waste collector (herein described as the "device") 10, where like reference numerals represent similar or like parts. The device 10 includes a shaft 15 equipped with a spool assembly 150 to feed and position a waste bag 155 around a clamp mechanism 50. In use, a user positions a deployed bag 155 over top of fecal matter 210. The clamp mechanism 50 then collapses the bag 155 around the fecal matter (not shown) allowing for hands-free disposal thereof.

Referring to FIG. 1, the device 10 includes the shaft 15. In one (1) embodiment, as illustrated in FIG. 1, the shaft 15 includes three (3) hollow sections of tube 20 (illustrated individually as a first tube 20*a*, a second tube 20*b*, and a third tube 20*c*). The device 10 includes a length of cord 30 (FIG. 3), an actuator mechanism 40, and the clamp mechanism 50.

Each hollow tube 20*a*, 20*b*, 20*c* can be made from a light weight, rigid polymer material and has a cylindrical shape. However, it is understood that other materials and configurations may be utilized without deviating from the teachings of the present disclosure and, as such, should not be interpreted as a limiting factor. The hollow construction of each tube 20*a*, 20*b*, 20*c* is a beneficial feature of the device 10 because it facilitates the housing of internal components of the device 10, enables movement of each component when manipulated, and allows the device 10 to be assembled and disassembled easily and efficiently.

Figure 2:
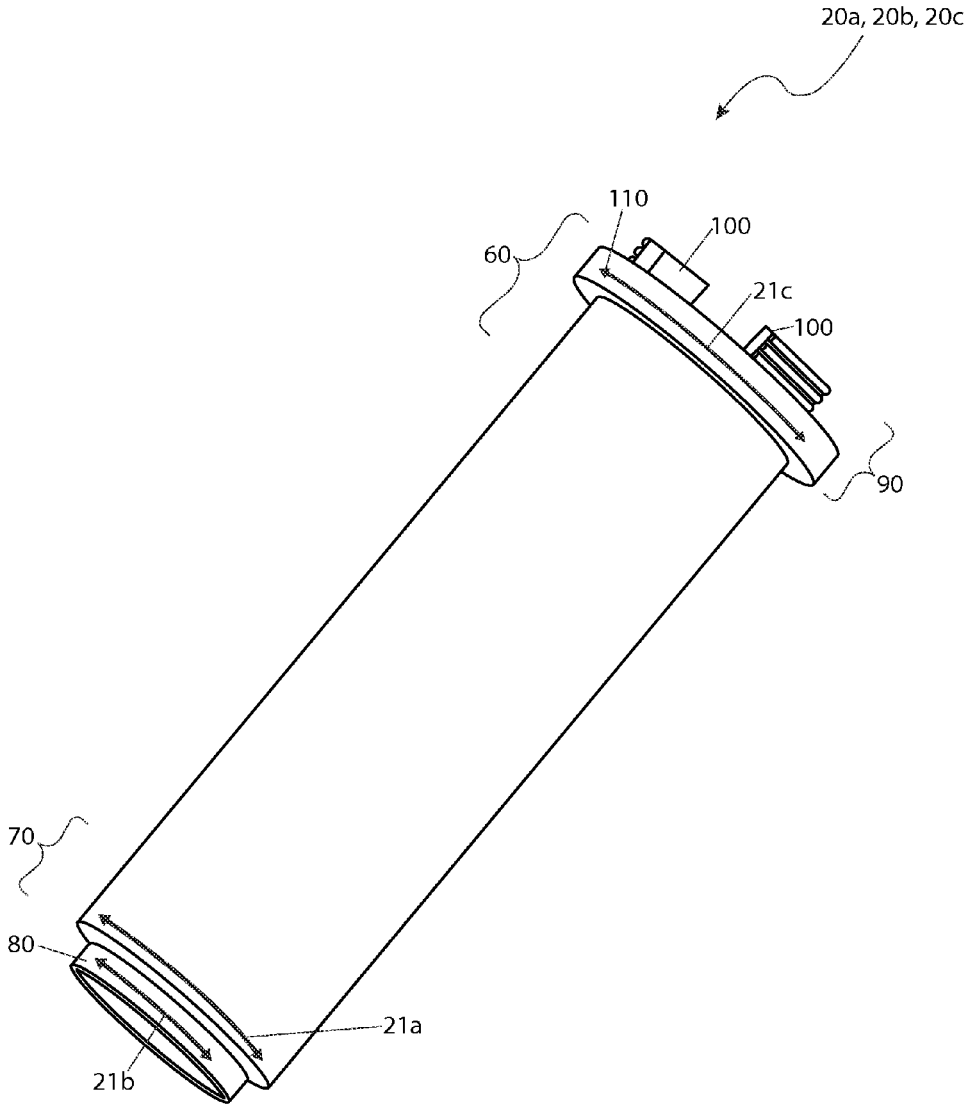
FIG. 2 is a perspective view of the tube of the pet waste collector.

Referring to FIG. 2, each tube 20*a*, 20*b*, 20*c* is configured to have a first end 60 and a second end 70. In an embodiment, each tube 20*a*, 20*b*, 20*c* is cylindrical and has a first degree of curvature 21*a* for its inner circumference and outer circumference. Each second end 70 of each tube 20*a*, 20*b*, 20*c* is configured to have a stripped surface 80 about an outer surface. Each outer circumference of each stripped surface 80 exhibits a second degree of curvature 21*b*. An outer diameter of each stripped surface 80 is less than that of an inner diameter of each first end 60 so that each second end 70 of a tube 20*a*, 20*b*, 20*c* is able to slidably insert into each first end 60 of a different tube 20*a*, 20*b*, 20*c*.

Each first end 60 of each tube 20*a*, 20*b*, 20*c* includes a locking coupling 90 affixed to an outer perimeter edge. Each locking coupling 90 includes at least two (2) flanges 100 and a locking mechanism 110. However, it is understood that other types or configurations of locking coupling 90 may be utilized without deviating from the teachings of the present disclosure and, as such, should not be interpreted as a limiting factor.

The flanges 100 are a cylindrical extension of each first end 60 of each tube 20*a*, 20*b*, 20*c*, having a third degree of curvature 21*c* for its inner surface, but an inner diameter slightly greater than that of an outer diameter of each first end 60. As a second end 70 of an inserting tube 20*a*, 20*b*, 20*c* is inserted into a first end 60 of a receiving tube 20*a*, 20*b*, 20*c*, each flange 100 of the locking coupling 90 of the first end 60 slidably receives an outer surface of the inserting tube 20*a*, 20*b*, 20*c* that is not stripped.

The locking mechanism 110 of each locking coupling 90 is positioned around an outer surface of each flange 70. When actuated, the locking mechanism 110 advances each flange 100 in a centripetal direction to securely fasten two (2) tubes 20*a*, 20*b*, 20*c* together. The flange 100, as best illustrated in FIG. 2, takes the form of a threaded fingered flange. A locking mechanism 110 in the form of a threaded locking nut acts upon the flanges 100 to advance each flange 100 in a centripetal direction.

To assemble the device 10, a second end 70 of one (1) tube 20*a*, 20*b*, 20*c* is inserted into a first end 60 of another tube 20*a*, 20*b*, 20*c* by way of the stripped surface 80 of the second end 70 of the inserting tube 20*a*, 20*b*, 20*c*. The flange 100 of the receiving tube 20*a*, 20*b*, 20*c* also receives an outer surface of the inserting tube 20*a*, 20*b*, 20*c*. The locking coupling 90 of the receiving tube 20*a*, 20*b*, 20*c* is actuated to make a secure fit between the two (2) tubes 20*a*, 20*b*, 20*c*. Actuating the locking coupling 90 in an opposite direction enables the user to detach the two (2) tubes 20*a*, 20*b*, 20*c* for disassembly of the device 10.

Figure 3:
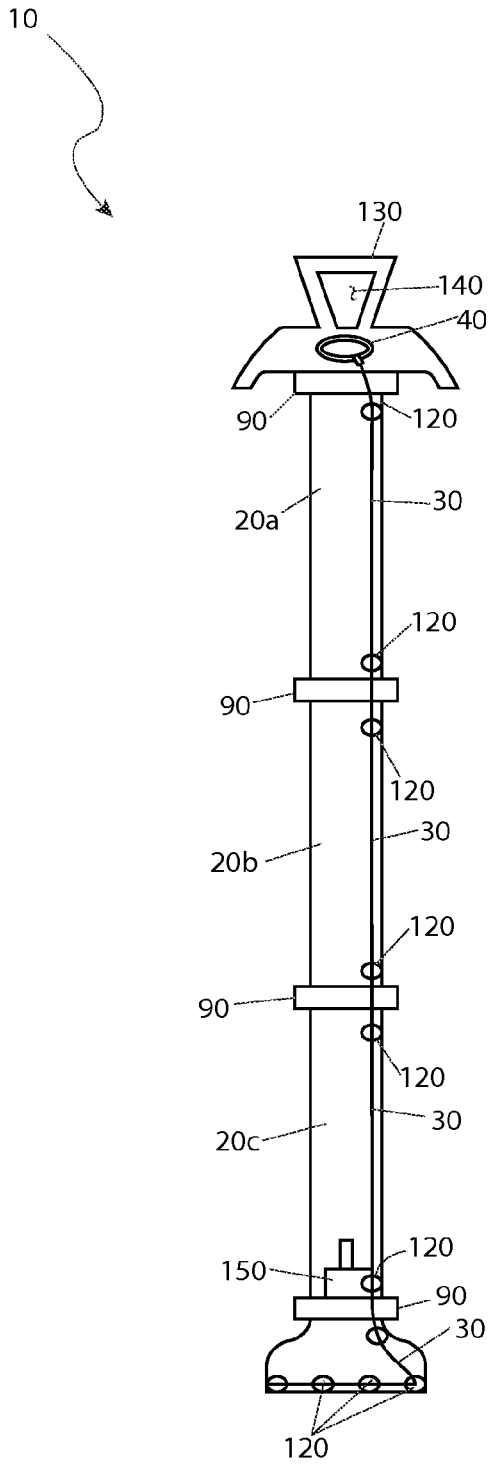
FIG. 3 is a cross sectional view of the pet waste collector taken along section line A-A of FIG. 1; and, FIG. 4 an enlarged front elevational view the handle of the pet waste collector.
Figure 4:
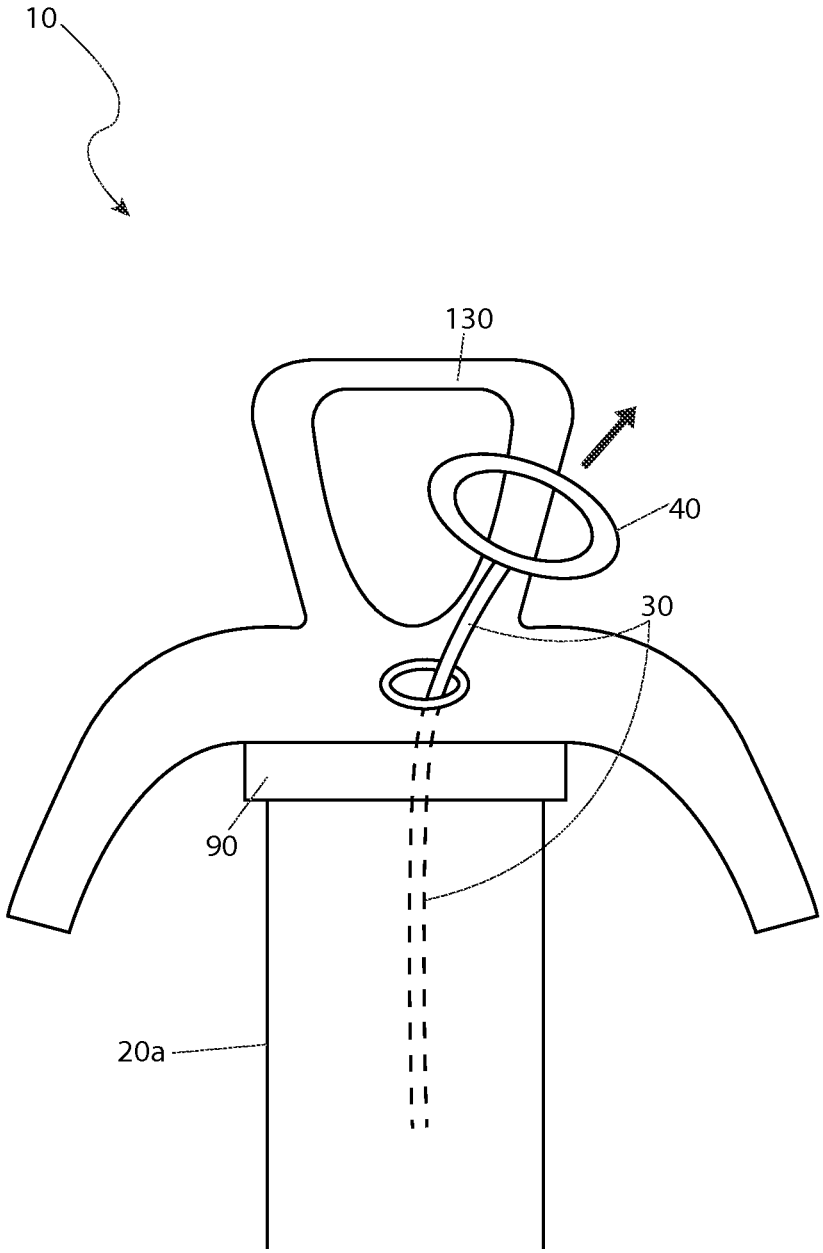

Referring to FIG. 3, an inside surface of each tube 20*a*, 20*b*, 20*c* is provided with a plurality of eyelets 120. These eyelets 120 serve as retention guides for the cord 30. The cord 30 can be a length of cable or string that is both flexible and able to transfer linear tensile forces. The flexibility of the cord 30 is important because the cord 30 remains attached to the inner surface of each tube 20*a*, 20*b*, 20*c*, whether the device 10 is assembled or disassembled. The cord 30 extends the length of the device 10 and is fastened to an inner surface of each tube 20*a*, 20*b*, 20*c* via the eyelets 120 by being routed therethrough. One (1) end of the cord 30 is placed into mechanical connection with the actuator mechanism 40, whereas an opposite end is placed into mechanical connection with the clamp mechanism 50.

The actuator mechanism 40 is attached to a handle 130 of the device 10. The handle 130 includes an additional integral stripped surface 80 that is secured to the first end 60 of the first tube 20*a*. The actuator mechanism 40 provides a mechanism that serves to manipulate the clamp mechanism 50 when displaced. An example embodiment of the actuator 40 is illustrated in FIG. 3 as being a pull-ring device being affixed to an end of the cord 30. However it is understood that other means such as, but not limited to; a trigger, a push-button member, or the like, may be utilized with equal benefit and should not be interpreted as a limiting factor.

The cord 30 is run from the actuator mechanism 40 and through each eyelet 120 of the first tube 20*a*. The subsequent second 20*b* and third 20*c* tubes are coupled to each other via the locking couplings 90 as the cord 30 is routed through each eyelet 120 of each tube 20*b*, 20*c*. A second end 70 of the third tube 20*c* is connected to the clamp mechanism 50 via a locking coupling 90 disposed on the clamp mechanism 50. The cord 30 is placed into mechanical connection with the clamp mechanism 50. The actuator mechanism 40 operates as a lever that transfers linear motion into the cord 30, which in turn transfers that motion to the clamp mechanism 50 to manipulate the clamp mechanism 50. The handle 130 can include an aperture 140 to enable hanging the device 10 while stowing the device 10.

The third tube 20*c* includes a spool assembly 150. The spool assembly 150 is positioned at terminus of the third tube 20*c* and situated at an inner surface of the third tube 20*c*. The spool assembly 150 holds a roll of waste bags 155 and positions each bag for readied use in the clamp mechanism 50 of the device 10.

The third tube 20 includes a hinged door 160 (FIG. 1) to contain and provide access to the spool assembly 150 to replenish the spool assembly 150 with a fresh roll of waste bags 155 when the need arises. The hinged door 160 includes a latch 170 (FIG. 1) to secure the door 160 in a closed position.

The clamp mechanism 50 includes a locking coupling 90 to facilitate removable attachment of the clamp mechanism 50 to the second end 70 of the third tube 20*c*. The clamp mechanism 50 includes a flexible framework 180 (FIG. 1), the peripheral of which creates a generally hemispherical shape having a subjacent circular mouth 190. A perimeter edge of the framework 180 is provided with a plurality of eyelets 120 (FIG. 3), through which the cord 30 is routed. The configuration of the clamp mechanism 50 and cord 30 is such that as a user pulls upon the actuator mechanism 40, the tensile forces imposed on the cord 30 collapses the perimeter edge of the framework 180 in a central direction.

Referring to FIG. 1, in preparing the device 10, a waste bag 155 is extracted from the hinged door 160 and is manually inserted into the framework 180 of the clamp mechanism 50 and around edges of the mouth 190 such that the mouth of the bag 155 protrudes horizontally outwardly from the mouth 190. As the actuator mechanism 40 is manipulated to advance the clamp mechanism 50 in a centripetal motion, the waste bag 155 is also forced into a centripetal motion.

A user positions the mouth 190 of the clamp mechanism 50, with a waste bag 155 being positioned as described above, over the fecal matter of an animal. Manipulating the actuator mechanism 40 advances the framework 180 and the waste bag 155 in a centripetal motion, entraining the fecal matter 210 within the waste bag 155. An upper surface of the clamp mechanism 50 includes a port 200. The port 200 allows a user to retrieve the waste bag 155 containing the entrained fecal matter from the clamp mechanism 50. A user's fingers are inserted into the port 200 to grasp the waste bag 155 and pull it through the port 200. A user's fingers maintain contact with an outside surface of the waste bag 155 so as to obviate inadvertent contact with the fecal matter. The port 200 is to be large enough to facilitate common size fecal matter associated with an animal, such as a dog.

Those skilled in the art will recognize that other styles and configurations of the disclosed device 10 can be easily incorporated into the teachings of the present disclosure, and only particular embodiments have been shown and described for purposes of clarity and disclosure and not by way of limitation of scope.

The disclosed embodiments of the device 10 can be utilized by the common user in a simple and effortless manner with little or no training. After initial purchase or acquisition of the device 10 it would be installed and utilized as illustrated in FIG. 1.

Referring to FIGS. 1-4, one embodiment of the disclosed method for preparing the device 10 for use includes the following steps: 1). acquiring the device 10; 2). assembling the shaft 15 by coupling a first end 60 of a first tube 20*a* to the stripped surface 80 of the actuator mechanism 40, coupling the second end 70 of the first tube 20*a* with a first end 60 of a second tube 20*b*, coupling the second end 70 of the second tube 20*b* with a first end 60 of a third tube 20*c*, and coupling the second end 70 of the third tube 20*c* with the locking coupling 90 of the clamp mechanism 50; 3). securing each piece together with the locking couplings 90; opening the hinged door 160 using the latch 170; 4). inserting a roll of waste bags 155 onto the spool assembly 150; and 5). closing the hinged door 160 and securing it shut with the latch 170. The device 10 is now ready for use.

Referring to FIGS. 1-4, one embodiment of the disclosed method for utilizing the device 10 includes the following steps: 1). extracting a waste bag 155 from the hinged door 160; 2). inserting the waste bag 155 manually up into the framework 180 of the clamp mechanism 50 and around edges of the mouth 190; 3). positioning the mouth 190 of the clamp mechanism 50 and the opening of the waste bag 155 over the fecal matter of an animal; 4). manipulating the actuator mechanism 40 to advance the framework 180 and the waste bag 155 in a centripetal motion; 5). allowing the waste bag 155 to entrain the fecal matter 210 within; 6). retrieving the waste bag 155 containing the entrained fecal matter by inserting fingers into the port 200 to grasp the waste bag 155; 7). pulling the waste bag 155 outwardly through the port 200; 8). disassembling the device 10 by detaching the tubes 20*a*, 20*b*, 20*c* of the shaft 15 from each other in reverse order of the assembly steps described above; and, 9). stowing the device 10 away, or keeping is assembled and hanging it upon a hook or similar appendage using the aperture 140.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A pet waste collector comprising:

a shaft having a first end and a second end, said shaft comprising a releasably interconnected plurality of tubes, each tube of said plurality of tubes comprising a plurality of locking flanges extending from an end thereof;

a locking mechanism movable over said plurality of locking flanges of said each tube to compress said plurality of locking flanges inwardly and connect said plurality of tubes end to end;

a clamp mechanism connected to said second end of said shaft; and, an actuator mechanism operably connected to said clamp mechanism, said actuator mechanism be disposed at said first end of said shaft;

wherein said clamp mechanism is movable between an open position and a closed position;

wherein said clamp mechanism is configured to retain a bag in said open position; and, wherein said clamp mechanism moves to said closed position in response to actuation of said actuator mechanism to capture pet waste within said bag.

2. The pet waste collector of claim 1, wherein said shaft further comprises a handle connected to said first end; wherein said actuator mechanism is adjacent to said handle.

3. The pet waste collector of claim 1, wherein each tube of said plurality of tubes comprises:

a first end; and, a second end opposite said first end;

wherein said second end of a first tube is insertably connected within said first end of a second tube.

4. The pet waste collector of claim 3, wherein said locking mechanism of said second tube secures said second end of said first tube within said first end of said second tube when said second end of said first tube is inserted within said first end of said second tube.

5. The pet waste collector of claim 3, wherein said plurality of locking flanges of said second tube engage said second end of said first tube within said first end of said second tube when said second end of said first tube is inserted within said first end of said second tube; and, wherein said locking mechanism moves over said plurality of locking flanges to compress said plurality of locking flanges around said second end of said first tube.

6. The pet waste collector of claim 1, wherein said clamp mechanism comprises a flexible framework defining a mouth; and wherein an edge of said bag is folded over said mouth.

7. The pet waste collector of claim 1, further comprising a flexible cord interconnected between said actuator mechanism and said clamp mechanism; wherein a tensile force applied to said cord by said actuator mechanism is transferred to said clamp mechanism to move said clamp mechanism to said closed position.

8. The pet waste collector of claim 7, wherein said actuator mechanism is a pull ring connected to an end of said cord at said first end of said shaft.

9. The pet waste collector of claim 7, wherein said cord extends through said shaft from said second end to said first end; and wherein said cord is movably connected to an inner surface of said shaft.

10. The pet waste collector of claim 1, further comprising a spool assembly disposed within said shaft at said second end; wherein said spool assembly comprises a plurality of bags wound therearound.

11. The pet waste collector of claim 1, further comprising a door hingedly connected to said shaft and covering an opening into said shaft; wherein said bag is removed from within said shaft through said opening.

12. A pet waste collector comprising:

a plurality of tubes, said plurality of tubes being releasably connected to form a shaft comprising a first end and a second end, each tube of said plurality of tubes comprising a plurality of locking flanges extending from an end thereof;

a locking mechanism movable over said plurality of locking flanges of said each tube to compress said plurality of locking flanges inwardly and connect said plurality of tubes end to end;

a clamp mechanism connected to a lowermost tube of said plurality of tubes at said second end of said shaft, said clamp mechanism comprising a flexible framework defining a mouth configured to retain a bag;

a flexible cord extending through said plurality of tubes from said first end of said shaft to said second end of said shaft, said cord comprising a first end and a second end, said second end connected to said mouth of said framework of said clamp mechanism;

an actuator mechanism connected to said first end of said cord;

a spool assembly disposed within said lowermost tube at said second end of said shaft, said spool assembly comprising a plurality of said bags wound therearound; and, a door hingedly connected to said lowermost tube at said second end of said shaft and covering an opening into said lowermost tube;

wherein said flexible framework of said clamp mechanism is biased in an open position;

wherein actuation of said actuator mechanism exerts a tensile force upon said mouth of said flexible framework of said clamp mechanism to move said flexible framework of said clamp mechanism to a closed position to capture pet waste within said bag; and, wherein said bag is removed from within said lowermost tube through said opening.

13. The pet waste collector of claim 12, wherein said shaft further comprises a handle connected to an uppermost tube of said plurality of tubes at said first end of said shaft; and wherein said actuator mechanism is adjacent to said handle.

14. The pet waste collector of claim 13, further comprising a plurality of locking couplings connecting said handle to said uppermost tube, and said clamp mechanism to said lowermost tube.

15. The pet waste collector of claim 13, wherein said locking mechanism threadingly engages over said plurality of locking flanges to compress said plurality of locking flanges inwardly.

16. The pet waste collector of claim 15, wherein said cord is movably connected to an inner surface of said each tube of said plurality of tubes.

* * * * *